US007266323B2

(12) United States Patent
Zirilli et al.

(10) Patent No.: US 7,266,323 B2
(45) Date of Patent: Sep. 4, 2007

(54) MANIFOLD FOR TONER COLLECTION AND CONTAMINATION CONTROL IN XEROGRAPHIC PROCESS DEVELOPER HOUSING

(75) Inventors: Francisco Zirilli, Penfield, NY (US); Andrew Charles LaRocca, Webster, NY (US)

(73) Assignee: Xerox Corporation, Stamford, CT (US)

( * ) Notice: Subject to any disclaimer, the term of this patent is extended or adjusted under 35 U.S.C. 154(b) by 257 days.

(21) Appl. No.: 11/111,337

(22) Filed: Apr. 21, 2005

(65) Prior Publication Data

US 2006/0239709 A1 Oct. 26, 2006

(51) Int. Cl.
*G03G 15/08* (2006.01)

(52) U.S. Cl. ..... 399/92; 399/98

(58) Field of Classification Search ..... 399/92, 399/98, 99, 119, 264, 266, 290
See application file for complete search history.

(56) References Cited

U.S. PATENT DOCUMENTS 3,680,528 A * 8/1972 Sanders ..... 118/50
3,951,539 A 4/1976 Draugelis
4,372,760 A * 2/1983 Van Zantwyk ..... 96/247
4,459,012 A * 7/1984 Allen et al. ..... 399/355
5,268,727 A 12/1993 Thayer et al.
5,321,484 A 6/1994 Kedarnath et al.
6,067,428 A * 5/2000 Zirilli et al. ..... 399/92
6,181,896 B1 1/2001 Zirilli et al.
6,522,859 B1 * 2/2003 Chappell ..... 399/343
6,813,457 B2 * 11/2004 Yoshiki ..... 399/92
2006/0072933 A1 * 4/2006 Miyamoto et al. ..... 399/92

FOREIGN PATENT DOCUMENTS

EP 629931 A1 * 12/1994
JP 362194271 A * 8/1987
JP 410161489 A * 6/1998

* cited by examiner

*Primary Examiner*—Robert Beatty
(74) *Attorney, Agent, or Firm*—Maginot, Moore & Beck

(57) ABSTRACT

An airborne toner collection manifold for an electrostatographic printer for coupling in fluid flow communication with a vacuum source includes an inlet, a collection duct, a first exhaust duct and a second exhaust duct. The inlet defines a gap slot extending longitudinally between a first end and a second end. The collection duct is adjacent to the inlet and has a first end extending longitudinally at least to the first end of the gap slot of the inlet and a second end extending longitudinally at least to the second end of the gap slot of the inlet. The collection duct defines a cavity in fluid flow communication with the gap slot. The first exhaust duct is in fluid flow communication with the cavity of the collection duct and is configured to be coupled for fluid flow communication with the vacuum source. The second exhaust duct is in fluid flow communication with the cavity of the collection duct and is configured to be coupled for fluid flow communication with the vacuum source. The second exhaust duct is displaced from the first exhaust duct and is positioned relative to the first exhaust duct to be closer to the second end of the collection duct.

16 Claims, 12 Drawing Sheets

MANIFOLD FOR TONER COLLECTION AND CONTAMINATION CONTROL IN XEROGRAPHIC PROCESS DEVELOPER HOUSING

BACKGROUND AND SUMMARY

This disclosure relates to electrostatographic systems and more particularly to manifolds for toner collection and contamination control in electrostatographic process developer housings.

The disclosed manifold can be used in the art of xerographic, electrophotographic or electrostatographic printing. Generally, the process of electrophotographic printing includes sensitizing a photoconductive surface by charging it to a substantially uniform potential. The charge is selectively dissipated in accordance with a pattern of activating radiation corresponding to a desired image. The selective dissipation of the charge leaves a latent charge pattern that is developed by bringing a developer material into contact therewith. This process forms a toner powder image on the photoconductive surface which is subsequently transferred to a copy sheet. Finally, the powder image is heated to permanently affix it to the copy sheet in image configuration.

Two component and single component developer materials are commonly used. A typical two component developer material comprises magnetic carrier granules having toner particles adhering triboelectrically thereto. A single component developer material typically comprises toner particles having an electrostatic charge so that they will be attracted to, and adhere to, the latent image on the photoconductive surface.

There are various known development systems for bringing toner particles to a latent image on a photoconductive surface. Single component development systems use a donor roll for transporting charged toner to the development nip defined by the donor roll and the photoconductive surface. The toner is developed on the latent image recorded on the photoconductive surface by a combination of mechanical scavengeless development. A scavengeless development system uses a donor roll with a plurality of electrode wires closely spaced therefrom in the development zone. An AC voltage is applied to the wires detaching the toner from the donor roll and forming a toner powder cloud in the development zone. The electrostatic fields generated by the latent image attract toner from the toner cloud to develop the latent image. In another type of scavengeless system, a magnetic developer roll attracts developer from a reservoir. The developer includes carrier and toner. The toner is attracted from the carrier to a donor roll. The donor roll then carries the toner into proximity with the latent image.

One method of controlling toner emissions from developer housings in electrostatographic equipment is to relieve any positive pressure generated in the housing. Moving components such as the mag brush rolls and the mixing augers can pump air into the housing, causing slight positive pressures. These positive pressures can result in air flow out of the housing via low impedance leakage paths. This air escaping from the housing contains entrained toner and is a major potential source of dirt within the electrostatographic system. A common approach to relieving this pressure is through the use of a "sump sucker". In its simplest form a sump sucker is a simple port into the air space above the developer material in the housing. This lowers the pressure in the housing below atmospheric pressure, therefore air flows into, rather than out of any low air impedance leakage paths within the housing. This toner laden air is drawn through a sump assembly. A shortcoming of these systems is that a considerable amount of toner emission contamination is present in the areas around the donor rolls in the developer housing. Additionally, excessive toner accumulation occurs on overhand trim features, and internal filtration is required to avoid excessive toner waste rates. The filtration operation results in frequent cleaning cycles to prevent clogging.

As electrostatographic printer process speeds increase, a corresponding increase of development roller angular velocities is required to maintain adequate developability or donor reload. The problem with escaping toner has become more acute and under these conditions toner emissions have increased and are considered a serious problem. Thus, merely having a vacuum source coupled to the housing has proven to insufficiently address the escaping toner issue. Therefore, it is a common practice to have the vacuum source connected to a manifold having an elongated opening adjacent either the location in which the toner cloud is created or adjacent the housing openings near the belt.

As mentioned above, the toner is airborne in a toner cloud during the transfer to the drum or belt. While most of the charged airborne toner adheres to the oppositely charged portions of the drum or belt, small amounts of the toner may remain airborne. The ability to control airborne toner has been a design issue in electrostatographic systems ever since toner was transferred to belts and drums by forming a toner cloud. One method adopted to control airborne toner in electrostatographic systems is to provide a dirt manifold for collecting the airborne toner that does not adhere to the transfer drum or belt. Such manifolds are often referred to as "dirt manifolds."

Two main issues exist in the implementation of manifolds for developer housings. First is the issue of uniformity of flow at the inlet of the manifold which collects airborne particles of toner at the exit of the housing or from inside the housing. The second is the transportability of these particles through the manifold and the connecting tubes to the cyclone separator and the final filter.

Electrostatographic process developer housings include a manifold for control of toner emissions in electrostatographic systems. Current manifolds in use for toner emissions utilize airflow through the manifold to transport airborne toner. Current manifolds include center pull and single end pull manifolds (collectively referred to hereinafter as "single pull manifolds"). As used herein, the term "single pull manifold" refers to a manifold having a collection chamber, duct or region in fluid communication with an inlet and in fluid communication with a vacuum source through a single exhaust duct. Single pull manifolds have been designed to meet the transportability requirement. However, the current single pull manifolds may suffer from lack of uniform air velocity in the collection regions allowing some toner particles to escape into the machine cavity of the xerographic system.

Referring to FIG. 11, a prior art single pull manifold 1100 is shown. The manifold 1100 includes an elongated inlet 1102 extending between a first end 1104 and a second end 1106, a collection duct 1108, and an exhaust duct 1110. The collection duct 1108 and inlet 1102 are in contiguous communication along the length of the internal portion of the inlet 1102. The single exhaust duct 1110 provides the single pull feature as all toner entering the inlet 1102 flows through the inlet 1102 and a chamber of the collection duct 1108 to the single exhaust duct 1110.

Referring now to FIG. 12, the simulated performance of the prior art single pull manifold 1100 is illustrated. In FIG. 12, the position (mm) is measured from the first end 1104 of the inlet 1102 (position 0.0 mm) to the second end 1106 of the inlet 1102 (position −400 mm). The simulation was run utilizing a simulated prior art single pull manifold 1100 connected to a vacuum source providing an air flow of fifteen cubic feet per minute. The prior art manifold 1100 contains a cross member stiffening rib in the inlet slot 1102 about 175 mm from the first end 1104 of the inlet 1102 resulting in a discontinuity in the graph of the air flow velocity vs. position at that point. More importantly, FIG. 12 reflects that the prior art single pull manifold 1100 has a non-uniform air velocity along the length of the inlet 1102. FIG. 12 indicates that the magnitude of the velocity of air flow is substantially reduced near the first end 1104 and second end 1106 of the inlet 1102 as compared to the central portions of the inlet 1002. This reduction of air velocity near the ends 1104, 1106 of the inlet 1102 may result in airborne toner adjacent the ends 1104, 1106 of the inlet 1102 escaping the vacuum source. That escaping toner can become deposited on surfaces of the developer housing or escape the developer housing and enter the main housing of the print engine.

Therefore, an airborne toner collection manifold with improved air velocity uniformity in the collection region would be appreciated.

The disclosed manifold is a dual end-pull manifold having two streams of airflow at the collection region to improve airflow uniformity in the collection region of the inlet section. As used herein the term "dual pull manifold" refers to a manifold having a collection chamber, duct or region in fluid communication with an inlet and in fluid communication with one or more vacuum sources through a two distinct spaced apart exhaust ducts. Consequently, a "dual end-pull manifold" has the two exhaust ducts located adjacent opposite ends of the collection chamber.

According to one aspect of the disclosure, an airborne toner collection manifold for coupling in fluid flow communication with a vacuum source includes an inlet, a collection duct, a first exhaust duct and a second exhaust duct. The inlet defines a gap slot extending longitudinally between a first end and a second end. The collection duct is adjacent to the inlet and has a first end extending longitudinally at least to the first end of the gap slot of the inlet and a second end extending longitudinally at least to the second end of the gap slot of the inlet. The collection duct defines a cavity in fluid flow communication with the gap slot. The first exhaust duct is in fluid flow communication with the cavity of the collection duct and is configured to be coupled for fluid flow communication with the vacuum source. The second exhaust duct is in fluid flow communication with the cavity of the collection duct and is configured to be coupled for fluid flow communication with the vacuum source. The second exhaust duct is displaced from the first exhaust duct and is positioned relative to the first exhaust duct to be closer to the second end of the collection duct.

According to another aspect of the disclosure a development system that controls the emission of airborne toner particles generated during a development process in an electrophotographic printing process includes a housing and a manifold. The housing defines a chamber in which the airborne toner particles are generated. The manifold includes an inlet, a collection duct, a first exhaust duct and a second exhaust duct. The inlet defines a gap slot extending longitudinally between a first end and a second end. The collection duct is adjacent to the inlet and has a first end extending longitudinally at least to the first end of the gap slot of the inlet and a second end extending longitudinally at least to the second end of the gap slot of the inlet. The collection duct defines a cavity in fluid flow communication with the gap slot. The first exhaust duct is in fluid flow communication with the cavity of the collection duct and is configured to be coupled for fluid flow communication with the vacuum source. The second exhaust duct is in fluid flow communication with the cavity of the collection duct and is configured to be coupled for fluid flow communication with the vacuum source. The second exhaust duct is displaced from the first exhaust duct and is positioned relative to the first exhaust duct to be closer to the second end of the collection duct. The manifold is positioned relative housing to subject airborne toner particles to a suction at the inlet gap when coupled to the vacuum source.

According to yet another aspect of the disclosure an electrophotographic printing machine comprises a development system, a vacuum source and a manifold. The development system has a housing defining a chamber and is configured to generate airborne toner particles in the chamber during a development process in an electrophotographic printing process. The manifold is configured and positioned relative to the housing of the development system to control the emission of airborne toner particles generated in the chamber of the housing of the development system. The manifold includes an inlet, a collection duct, a first exhaust duct and a second exhaust duct. The inlet defines a gap slot extending longitudinally between a first end and a second end. The collection duct is adjacent to the inlet and has a first end extending longitudinally at least to the first end of the gap slot of the inlet and a second end extending longitudinally at least to the second end of the gap slot of the inlet. The collection duct defines a cavity in fluid flow communication with the gap slot. The first exhaust duct is in fluid flow communication with the cavity of the collection duct and the vacuum source. The second exhaust duct is in fluid flow communication with the cavity of the collection duct and the vacuum source. The second exhaust duct is displaced from the first exhaust duct and is positioned relative to the first exhaust duct closer to the second end of the collection duct.

Additional features and advantages of the presently disclosed toner collection manifold for an electrostatographic printer will become apparent to those skilled in the art upon consideration of the following detailed description of embodiments exemplifying the best mode of carrying out the disclosed apparatus as presently perceived.

BRIEF DESCRIPTION OF THE DRAWINGS

A more complete understanding of the disclosed apparatus can be obtained by reference to the accompanying drawings wherein.

Corresponding reference characters indicate corresponding parts throughout the several views. Like reference characters tend to indicate like parts throughout the several views.

DETAILED DESCRIPTION

Figure 1:
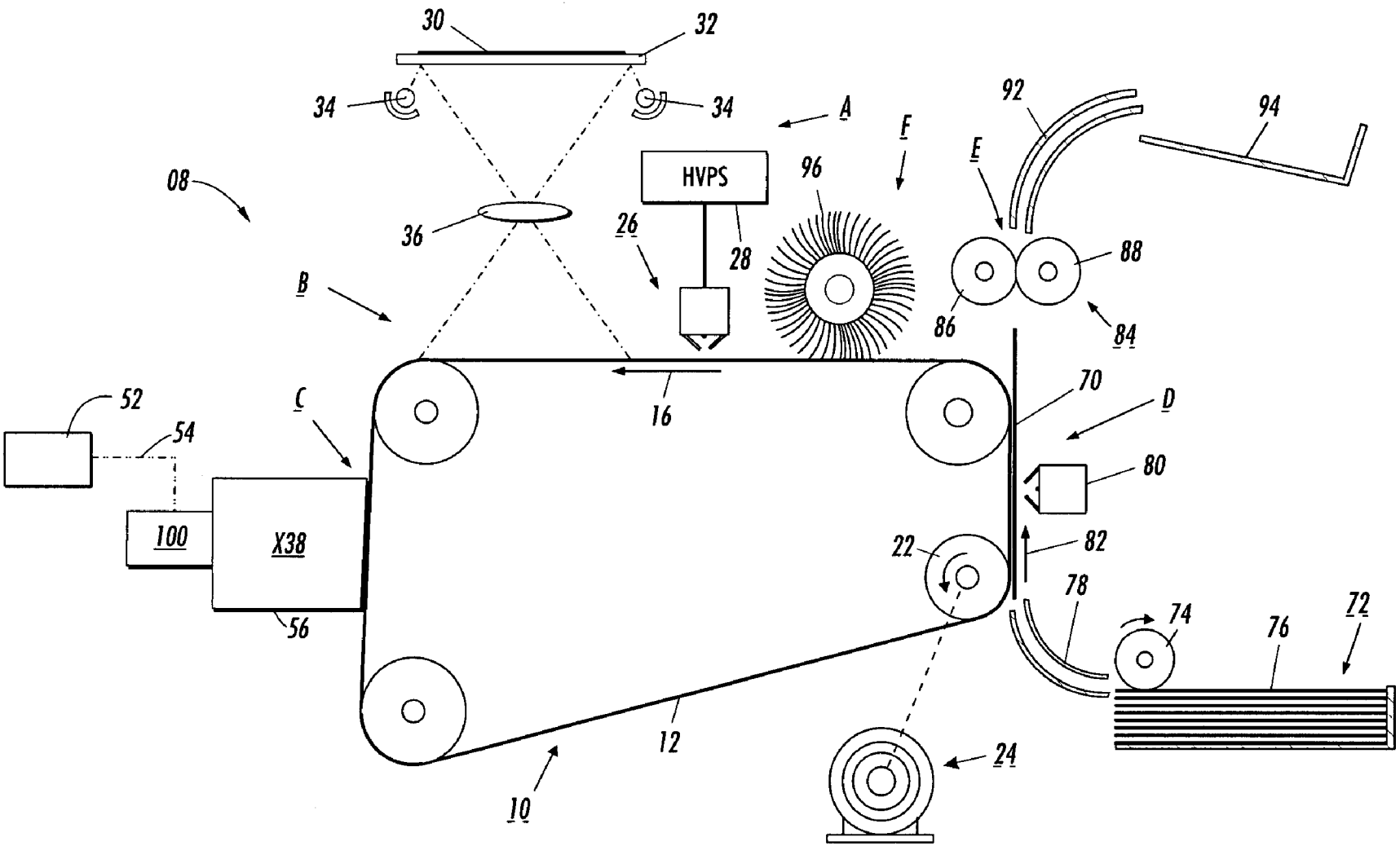
FIG. 1 is a schematic elevation view of an illustrative electrophotographic printing machine with a developer unit shown diagramatically.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art to which this disclosure pertains.

Inasmuch as the art of electrophotographic printing is well known, the various processing stations employed in the FIG. 1 printing machine 08 will be shown hereinafter schematically and their operation described briefly with reference thereto.

Referring initially to FIG. 1, there is shown an illustrative electrophotographic printing machine 08 incorporating a development station C that has airborne toner removed from the housing thereof by at least one dual flow manifold 100 connected to a vacuum source 52. The electrophotographic printing machine 08 employs a belt 10 having a photoconductive surface 12 deposited on a conductive substrate. The belt 10 moves in the direction of arrow 16 to advance successive portions of the photoconductive surface 12 sequentially through the various processing stations A-F disposed throughout the path of movement thereof. A motor 24 rotates the belt 10 in the direction of arrow 16. A roller 22 is coupled to the motor 24 by suitable means, such as a drive belt.

Initially, a portion of the belt 10 passes through a charging station A. At the charging station A, a corona generating device 26 charges the photoconductive surface 12 to a relatively high, substantially uniform potential. A high voltage power supply 28 is coupled to the corona generating device 26 to charge the photoconductive surface 12 of the belt 10. After the photoconductive surface 12 of the belt 10 is charged, the charged portion thereof is advanced through an exposure station B.

At the exposure station B, an original document 30 is placed face down upon a transparent platen 32. Lamps 34 flash light rays onto the original document 30. The light rays reflected from the original document 30 are transmitted through a lens 36 to form a light image thereof. The lens 36 focuses this light image onto the charged portion of the photoconductive surface 12 to selectively dissipate the charge thereon. This records an electrostatic latent image on the photoconductive surface 12 that corresponds to the informational areas contained within the original document 30.

After the electrostatic latent image has been recorded on the photoconductive surface 12, the belt 10 advances the latent image to a development station C. At the development station C, a developer unit, indicated generally by the reference numeral X38, develops the latent image recorded on the photoconductive surface 12. The latent image attracts toner particles from the toner powder cloud 43 forming a toner powder image thereon. Toner remaining airborne in the chamber of the developer housing 56 is removed therefrom by at least one dual pull manifold 100 coupled to a vacuum source 52. The chamber in the developer housing 56 stores a supply of developer material.

With continued reference to FIG. 1, after the electrostatic latent image is developed, the belt 10 advances the toner powder image to a transfer station D. A copy sheet 70 is advanced to the transfer station D by a sheet feeding apparatus 72. Preferably, the sheet feeding apparatus 72 includes a feed roll 74 contacting the,uppermost sheet of stack 76 for feeding the sheet into a chute 78. The chute 78 directs the advancing sheet of support material into contact with the photoconductive surface 12 of the belt 10 in a timed sequence so that the toner powder image developed thereon contacts the advancing sheet at the transfer station D. The transfer station D includes a corona generating device 80 which sprays ions onto the back side of the sheet 70. This attracts the toner powder image from the photoconductive surface 12 to the sheet 70. After toner transfer, the sheet 70 continues to move in the direction of arrow 82 onto a conveyor (not shown) that advances the sheet 70 to a fusing station E.

The fusing station E includes a fuser assembly 84, which permanently affixes the transferred powder image to the sheet 70. The fuser assembly 84 includes a heated fuser roller 86 and a back-up roller 88. The sheet 70 passes between the fuser roller 86 and the back-up roller 88 with the toner powder image contacting the fuser roller 86. In this manner, the toner powder image is permanently affixed to the sheet 70. After fusing, the sheet 70 advances through a chute 92 to a catch tray 94 for subsequent removal from the printing machine 08 by an operator.

After the copy sheet 70 is separated from the photoconductive surface 12 of the belt 10, the residual toner particles adhering to the photoconductive surface 12 are removed therefrom at a cleaning station F. The cleaning station F includes a rotatably mounted fibrous brush 96 in contact with the photoconductive surface 12. The residual toner particles are cleaned from the photoconductive surface 12 by the rotation of the brush 96 in contact therewith. After cleaning, a discharge lamp (not shown) floods the photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine 08 within which the manifold 100 disclosed herein is utilized.

Figure 2:
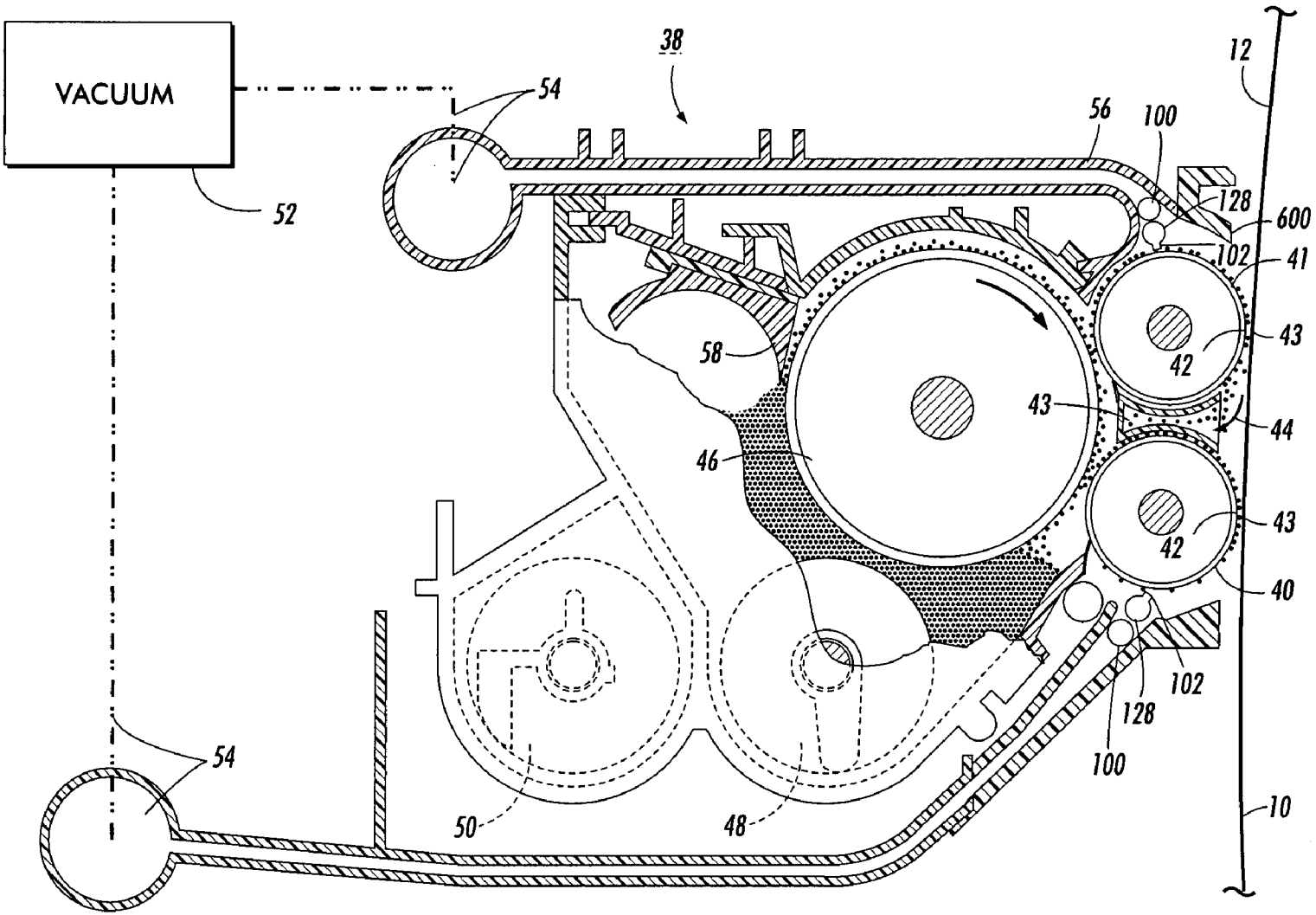
FIG. 2 is a schematic elevation view showing one type of developer unit used in the printing machine of FIG. 1 within which the disclosed manifold may be utilized.

Referring now to FIG. 2, there is shown as first embodiment of development system 38 and the manifold 100 disclosed herein in greater detail. The development system 38 includes donor rolls 40 and 41, electrode wires 42, and a magnetic metering roll 46. The roll 46 supplies charged toner to the donor rolls 40 and 41. The donor rolls 40 and 41 can be rotated in either the 'with' or 'against' direction relative to the direction of motion of the belt 10. The donor roll 41 is shown rotating in the direction of the arrow 44. Augers 48 and 50 mix developer material, which is supplied to the magnetic roll 46.

The developer apparatus 38 further has electrode wires 42 located in the space between the photoconductive surface 12 and the donor rolls 40 and 41. The electrode wires 42 include one or more thin metallic wires which are lightly positioned against the donor rolls 40 and 41. The distance between the wires 42 and the donor rolls 40 and 41 is approximately the thickness of the toner layer on the donor rolls 40 and 41. The extremities of the wires 42 are supported by rectangular frame modules (not shown) located around the periphery of each donor roll 40, 41.

An electrical bias is applied to the electrode wires 42 by a power source (not shown). The bias establishes an electrostatic field between the wires 42 and the donor rolls 40 and 41, which is effective in detaching toner from the surface of the donor rolls 40 and 41 and forming a toner cloud 43 about the wires 42.

A DC bias supply (not shown) establishes an electrostatic field between the photoconductive surface 12 and the donor rolls 40 and 41 for attracting the detached toner particles from the cloud 43 surrounding the wires 42 to the latent image on the photoconductive surface 12. A DC bias supply (not shown) establishes an electrostatic field between the magnetic roll 46 and donor rolls 40 and 41 which causes toner particles to be attracted from the magnetic roll 46 to the donor rolls 40 and 41. A metering blade portion 58 can be positioned closely adjacent to the magnetic roll 46 to maintain the compressed pile height of the developer material on the magnetic roll 46 at the desired level.

The magnetic roll 46 includes a non-magnetic tubular member or sleeve made preferably from aluminum and having the exterior circumferential surface thereof roughened. An elongated multiple magnet is positioned interiorly of and spaced from the tubular member. The elongated magnet is mounted on bearings and coupled to the motor. The sleeve may also be mounted on suitable bearings and coupled to the motor. Toner particles are attracted from the carrier granules on the magnetic roll 46 to the donor rolls 40, 41. A zone of minimal magnetic field allows denuded carrier granules and extraneous developer material to fall away from the surface of the sleeve.

In the illustrated embodiment of development system 38, two dual pull manifolds 100 are mounted in the interior of the housing 56 adjacent the donor rolls 40, 41. Each manifold 100 is coupled through appropriate ductwork 54 to the vacuum source 52 so that a low pressure area is created along the inlet section 102 of each manifold 100. Airborne toner from the toner cloud 43 that is not attracted to the photoconductive surface 12 are vacuumed through the inlet gaps 128 of the manifolds 100 and transported by the vacuum to a cyclone separator (not shown).

Figure 3:
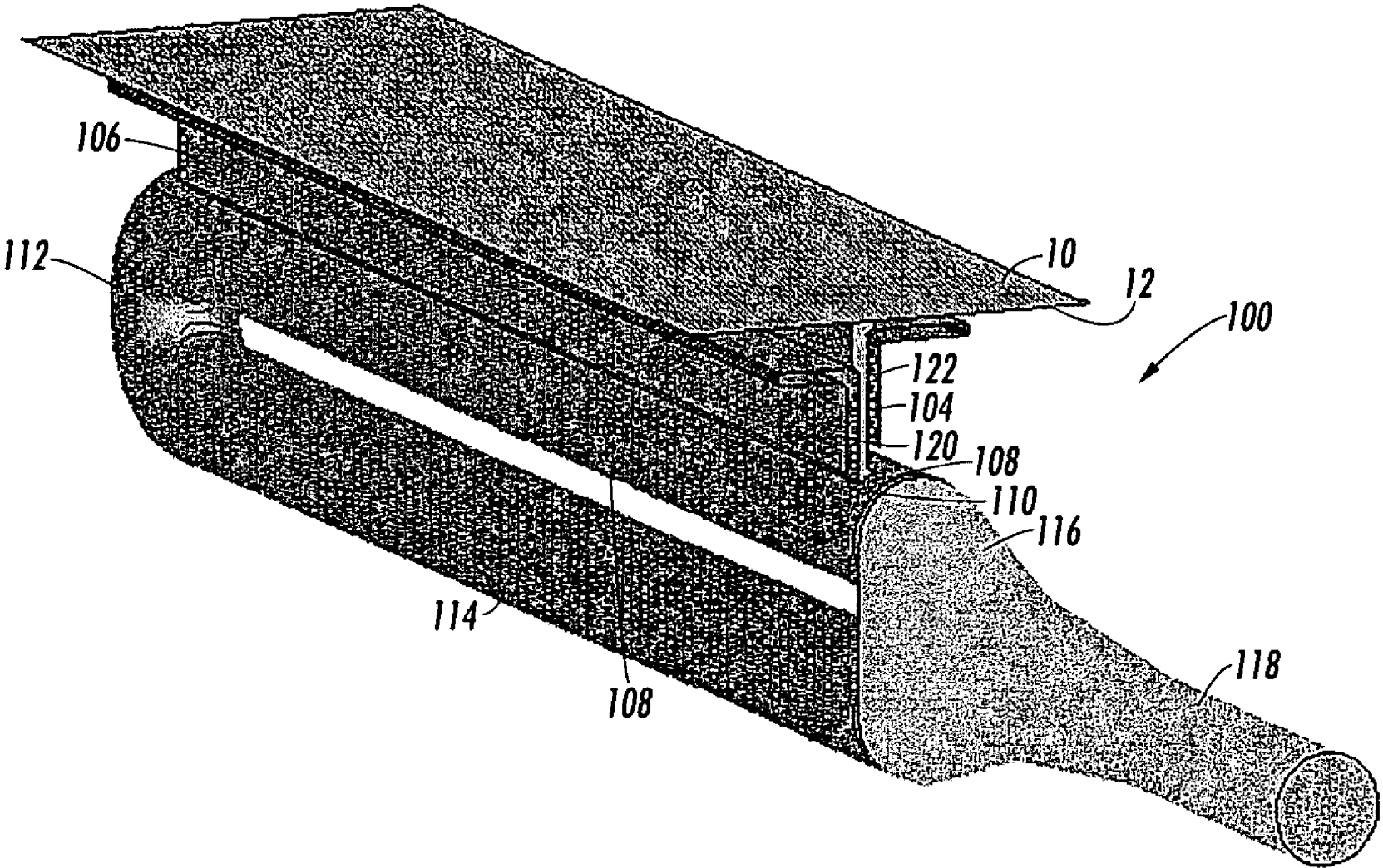
FIG. 3 is a perspective view of the dual stream manifold for a developer housing showing the manifold disposed adjacent a belt having a photoconductive surface and showing the manifold having an inlet, a collection duct, a bent pipe section, a transition region and a main flow conduit.
Figure 4:
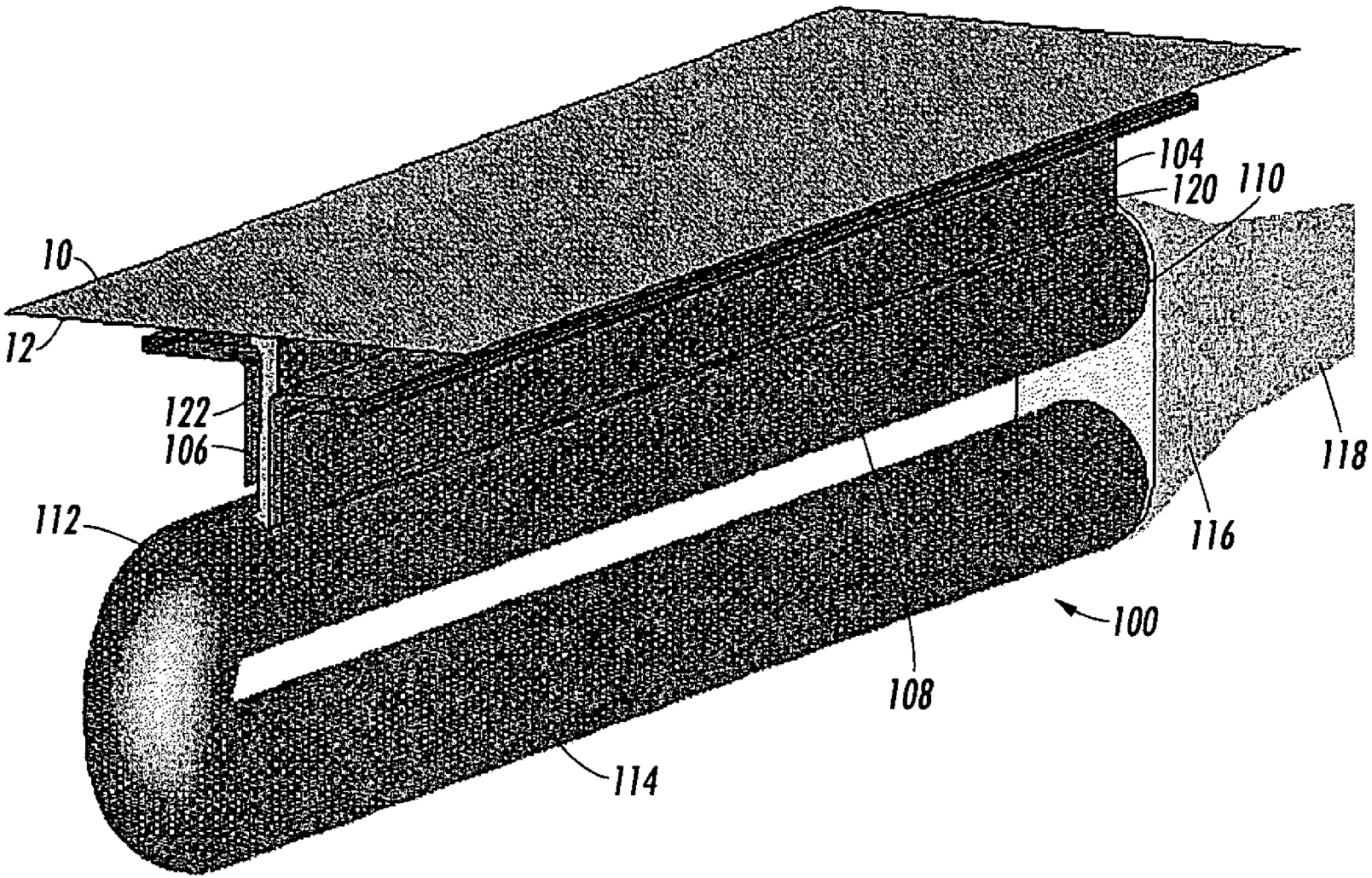
FIG. 4 is a perspective view of the dual stream manifold of FIG. 3.
Figure 5:
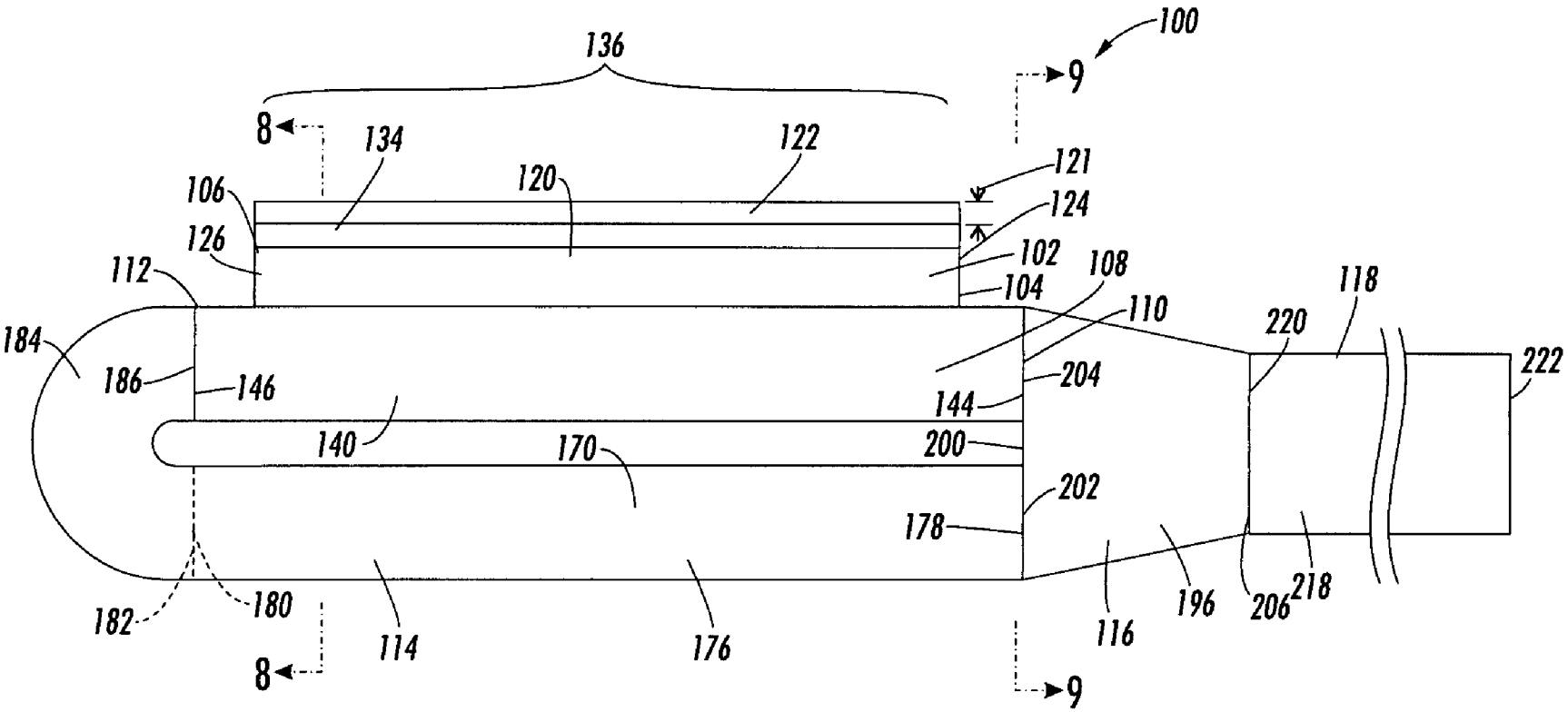
FIG. 5 is a front elevation view of the manifold of FIG. 3.
Figure 6:
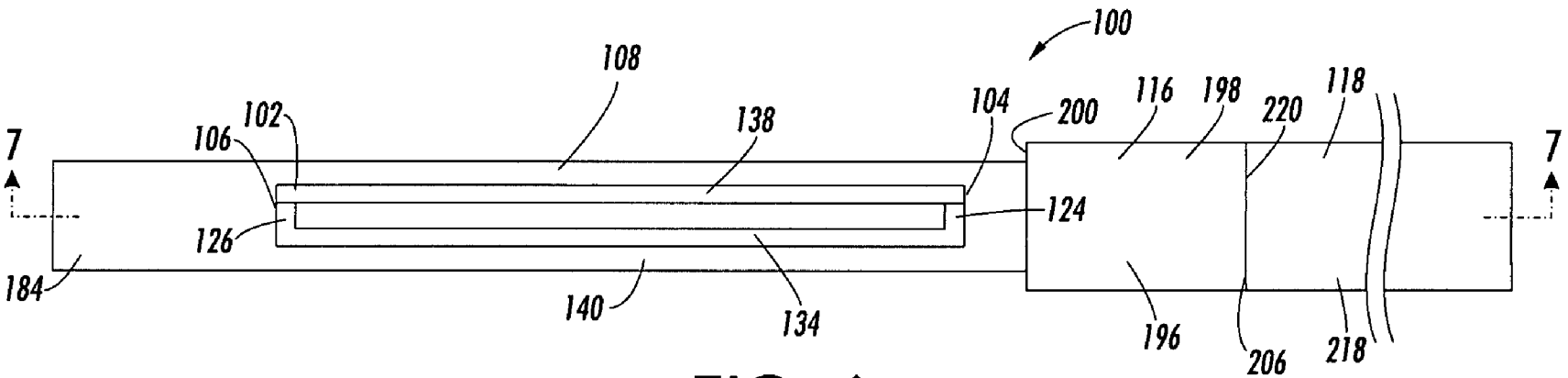
FIG. 6 is a top plan view of the manifold of FIG. 3.
Figure 7:
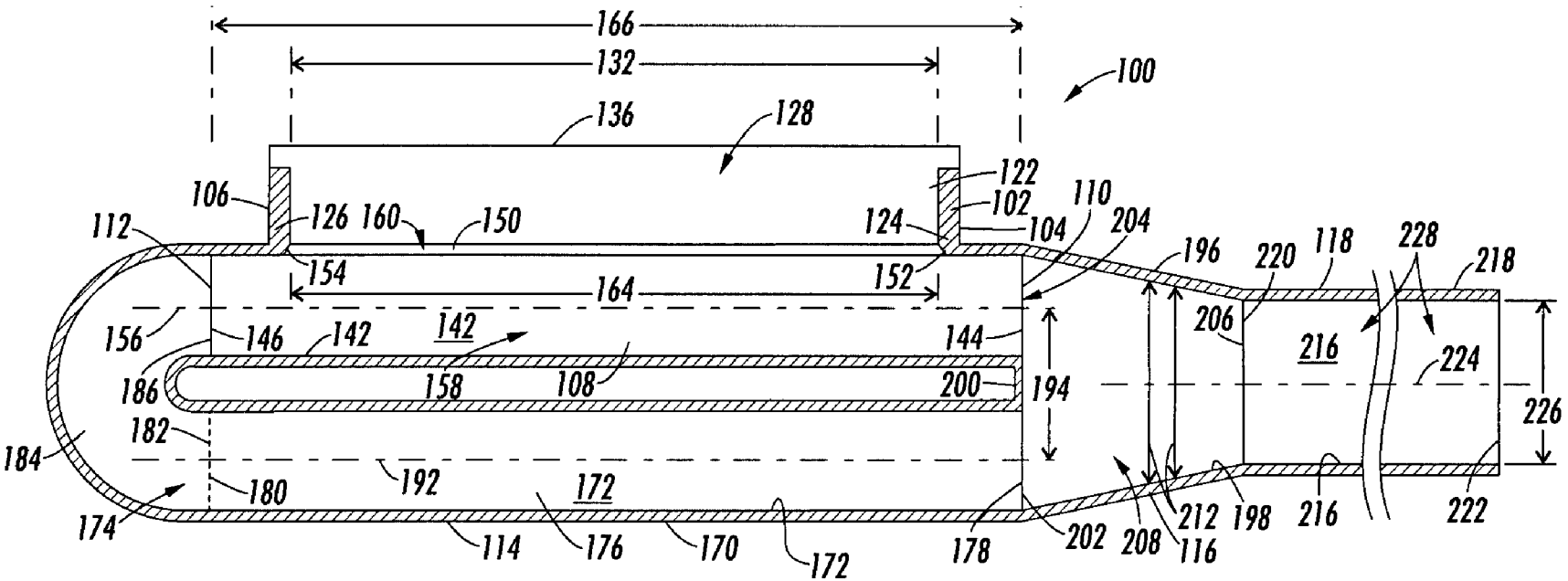
FIG. 7 is a sectional view taken along line 7-7 of the manifold of FIG. 6.
Figure 8:
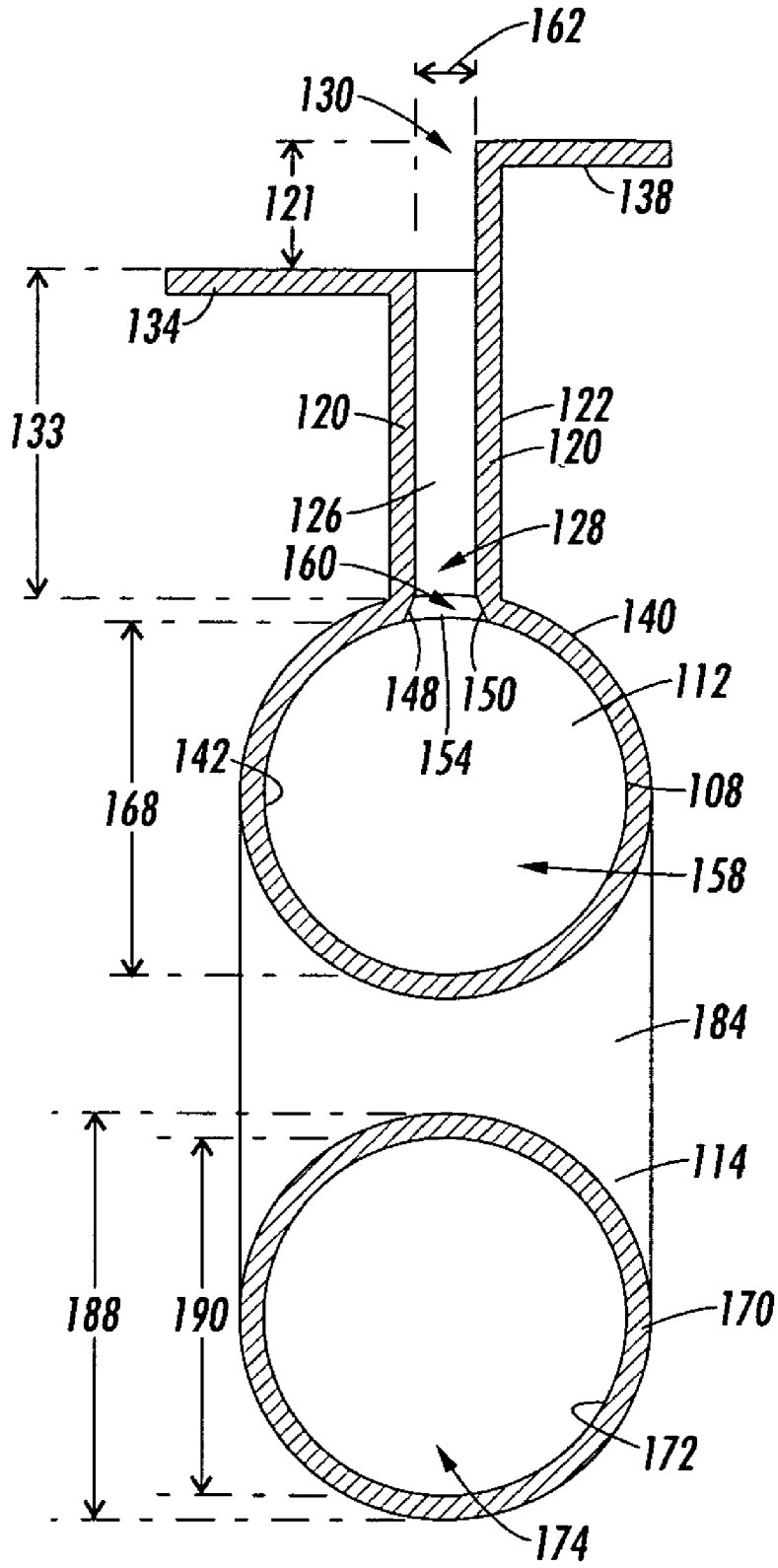
FIG. 8 is a sectional view taken along line 8-8 of the manifold of FIG. 5.
Figure 9:
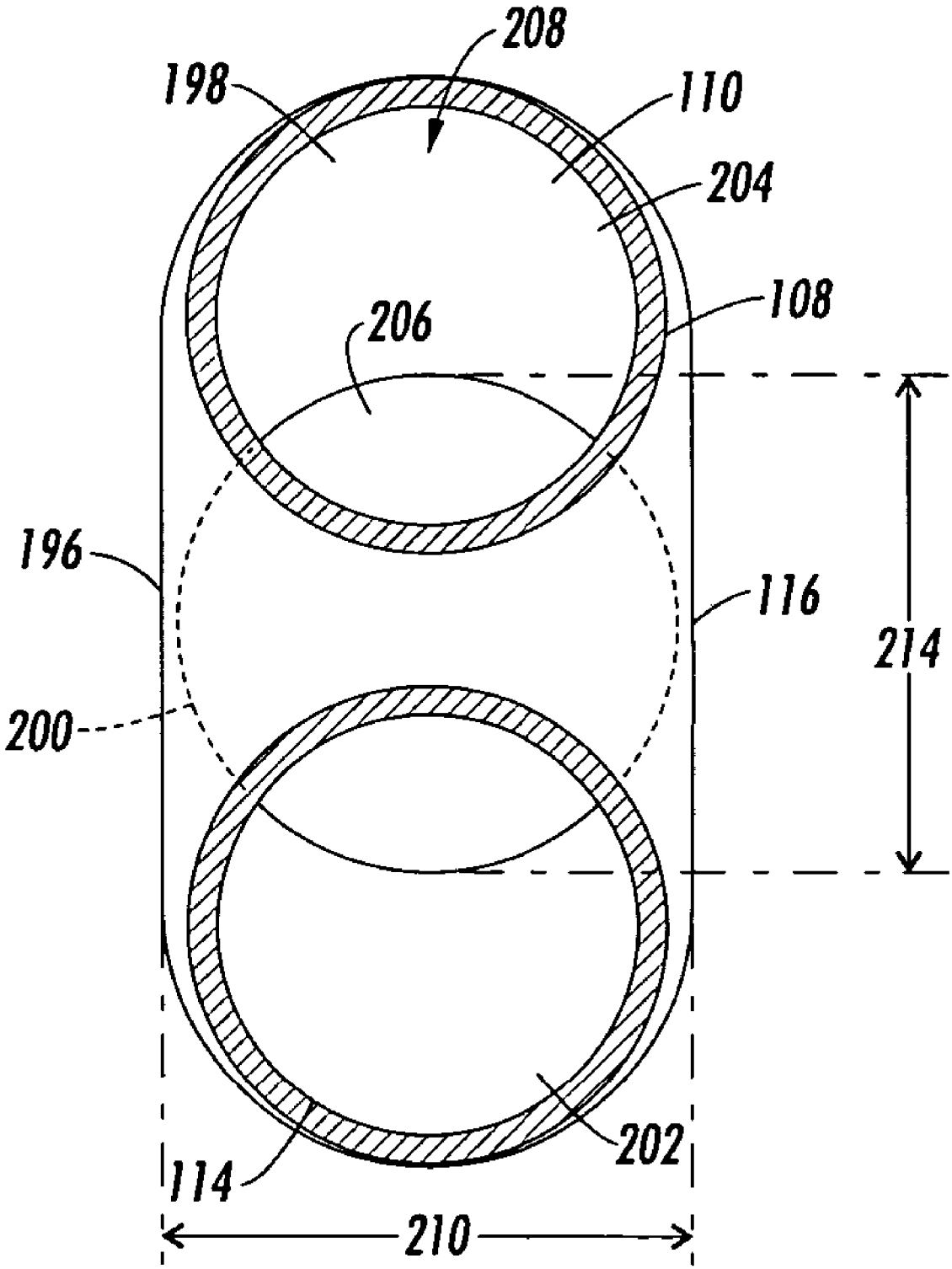
FIG. 9 is a sectional view taken along line 9-9 of the manifold of FIG. 5.

While not separately illustrated or described, the disclosed manifold may be utilized with other types of development systems X38. While the disclosed development system disposes two manifolds 100 within the interior of the chamber of the developer housing 56, many development systems utilize dirt manifolds that are disposed adjacent the developer housing adjacent the gap formed between the developer housing and the belt 10. The disclosed manifold 100 may be utilized with such development systems X38 and be disposed adjacent the belt 10, as shown, for example, in FIG. 3, in the same location in which dirt manifolds are currently disposed with such development systems X38.

Referring now to FIGS. 3-9, the dual pull manifold 100 is shown in greater detail. The dual pull manifold 100 includes an elongated inlet section 102 extending between a first end 104 and a second end 106, a collection duct section 108, a first exhaust duct 110, a second exhaust duct 112, a bent pipe section 114, a transition region 116 and a main flow conduit 118. The elongated inlet section 102 is formed by a front wall 120, a rear wall 122, a first end wall 124 and a second end wall 126. The first end wall 124 extends between and joins the first end of the front wall 120 and the first end of the rear wall 122. Similarly, the second end wall 126 extends between and joins the second end of the front wall 120 and the second end of the rear wall 122. The front wall 120 is mounted generally parallel to the rear wall 122 and forms an inlet gap 128 therebetween having a substantially uniform width 130 along the length 132 of the inlet gap 128.

As shown, for example, in FIGS. 3, 4, 5, 7 and 8, the rear wall 122 extends above front wall 120 by a displacement 121 which in the illustrated embodiment is approximately 6 mm. Thus, when the manifold 100 is mounted adjacent a photoreceptor 10, as shown, for example, in FIG. 3 there is a difference in the gap between the photoreceptor 10 and the front wall 120 and the photoreceptor 10 and the rear wall 122. In one illustrative embodiment, an inlet gap of about 8 mm is formed between the photoreceptor 10 and the front wall 120 and an inlet gap of about 2 mm is formed between the photoreceptor 10 and the rear wall 122. A similar difference in gaps is created when the manifold 100 is mounted adjacent the donor rolls 40 and 41. Different gaps are formed to slow down the toner particles going into the manifold 100 and prevent them from crashing into the rear wall 122. This also reduces the chances of the manifold 100 from clogging up. If speed reduction of the toner particles was obtained by reducing the overall airflow in the manifold 100 instead of in the manner described above, the total flow in the manifold 100 might not be able to transport the particles through the rest of the manifold 100 and the tubing. In the illustrated embodiment, the length 132 of the inlet gap 128 is approximately 380 millimeters.

In the illustrated embodiment, the width 130 of the inlet gap 128 is approximately two millimeters. The inlet gap 128 also has a depth 133 of approximately twenty-three millimeters.

In the illustrated embodiment, the front wall 120 is bent to form a perpendicularly extending lip 134 adjacent the collection region 136 of the inlet section 102. Similarly, the rear wall 122 is bent to form a perpendicularly extending lip 138 adjacent the collection region 136 of the inlet section 102. The bottom ends of the front wall 120, the rear wall 122, the first end wall 124 and the second end wall 126 are mounted to the outside wall 140 of the collection duct section 108. The bottom end of front wall 120 is mounted to the outside wall 140 of the collection duct section 108 on the front side of a longitudinal slot 160 formed in the collection duct section 108. Similarly, the bottom of the rear wall 122 is mounted to the outside wall 140 of the collection duct section 108 on the rear side of the longitudinal slot 160. The bottom of the first end wall 124 is mounted to the outside wall 140 of the collection duct section 108 on the first end of the longitudinal slot 160 and the bottom of the second end wall 126 is mounted to the outside wall 140 of the collection duct section 108 on the second end of the longitudinal slot 160. Thus, the interior cavity 158 of the collection duct section 108 is in fluid flow communication with the inlet gap 128 through the longitudinal slot 160.

The collection duct section includes an outside wall 140, an inside wall 142, a first end 144, a second end 146, a front slot wall 148, a rear slot wall 150, a first slot end wall 152, a second slot end wall 154 and a longitudinal axis 156. The outside wall 140 and inside wall 142 of the collection duct section 108 are formed generally concentrically about the longitudinal axis 156. The inside wall 142 of the collection duct section 108 defines a cavity 158.

The front slot wall 148, rear slot wall 150, first slot end wall 152 and second slot end wall 154 extend inwardly from the outside wall 140 to the inside wall 142 to define the longitudinal slot 160. The first slot end wall 152 extends between and joins the first end of the front slot wall 148 and the first end of the rear slot wall 150. Similarly, the second slot end wall 154 extends between and joins the second end of the front slot wall 148 and the second end of the rear slot wall 150. The front slot wall 148 is mounted generally parallel to the rear slot wall 150.

The longitudinal slot 160 has a substantially uniform width 162 along its entire length 164. Illustratively, the width 162 of longitudinal slot 160 is approximately equal to the width 130 of the inlet gap 128 of the inlet section 102. Also, the length 164 of the longitudinal slot 160 is approximately equal to the length 132 of the inlet gap 128 of the inlet section 102. Thus, there is a smooth transition between the inlet gap 128 and the longitudinal slot 160.

The longitudinal slot 160 extends inwardly between the outside wall 140 and the inside wall 142 to provide fluid flow communication between the cavity 158 and the inlet gap 128. The cavity 158 is open at the first end 144 to provide fluid flow communication with the first exhaust duct 110 and is open at the second end 146 to provide fluid flow communication with the second exhaust duct 112. Those skilled in the art will recognize that the collection duct section 108 is essentially a tube having a length 166 and an inside diameter 168. The length 166 of collection duct section 108 is greater than the length 132 of the inlet gap 128. Illustratively the length 166 of the collection duct section 108 is approximately 400 millimeters. The diameter 168 of the cavity 158 of the collection duct section 108 is illustratively approximately twenty-nine millimeters.

The bent pipe section 114 includes an outer wall 170 and an inner wall 172 which defines a conduit 174. The bent pipe section 114 includes straight section 176 having an open first end 178 and a second end 180 coupled to a first end 182 of a U-shaped section 184 that has a second open end 186. In the illustrated embodiment, bent pipe section 114 is formed from a pipe having a substantially uniform outside diameter 188 and a substantially uniform inside diameter 190. The pipe is bent adjacent one end to form the U-shaped section 184.

The second end 186 of the U-shaped section 184 is coupled to the second end 146 of the collection duct section 108 so that the conduit 174 of the bent pipe section 114 is in fluid flow communication with the cavity 158 of the collection duct section 108 through the second exhaust duct 112. The junction formed by the second end 186 of the bent pipe section 114 and the second end 146 of the collection duct section 108 defines the second exhaust duct 112 of the dual stream manifold 100.

The straight section 176 of the bent pipe section 114 is formed generally concentrically about a longitudinal axis 192. The longitudinal axis 192 of the straight section 176 of the bent pipe section 114 runs generally parallel to the longitudinal axis of the collection duct section 108. The first end 178 of the bent pipe section 114 is positioned longitudinally in approximately the same longitudinal position as the first end 144 of the collection duct section 108. The center of the open first end 178 of the bent pipe section 114 is displaced from the center of the first end 144 of the collection duct section 108 by a displacement 194.

The transition region 116 includes an outside wall 196, an inside wall 198, a first end wall 200 formed to include a first inlet 202 and a second inlet 204 and an outlet 206. The inside wall 198 forms a chamber 208 tapering smoothly from the first end wall 200 toward the outlet 206. The first inlet 202 is generally circular and is sized to receive the first end 178 of the straight section 176 of the bent pipe section 114. The second inlet 204 is generally circular and is sized to receive the first end 144 of the collection duct section 108.

The inside wall 198 of the transition region 116 has a generally oval cross-section with a constant minor axis 210. The lengths of the major axes 212 of the inside wall 198 of the transition region 116 become smaller between the first end wall 200 and the outlet 206 until the length of the major axis 212 is approximately equal to the length of the minor axis 210 at the outlet 206. Thus, the inside wall 198 of the transition region 116 has a generally circular cross section at the outlet 206. The diameter 214 of the inside wall 198 of the transition region 116 at the outlet 206 is approximately equal to the inside diameter 226 of the main flow conduit 118. The outlet 206 of the transition region 116 is coupled to the inlet end 220 of the main flow conduit 118 to provide fluid flow communication between the chamber 208 of the transition region 116 and the conduit 228 of the main flow conduit 118.

The main flow conduit 118 includes an inside wall 216, an outside wall 218, an inlet end 220, an outlet end 222 and a longitudinal axis 224. The inside wall 216 and outside wall 218 are formed generally concentrically about the longitudinal axis 224. The inside wall 216 has an inside diameter 226 which in the illustrated embodiment is approximately equal to the diameter 214 of the inside wall 198 at the outlet 206 of the transition region 116. The inside wall 216 of the main flow conduit 118 defines a conduit 228. The inlet end 220 of the main flow conduit 118 is coupled to the outlet 206 of the transition region 116 to provide fluid flow communication between the chamber 208 of the transition region 116 and the conduit 228 of the main flow conduit 118. The outlet end 222 is coupled through appropriate ducting 54 to the vacuum source 52.

The first end 178 of the straight section 176 is coupled in fluid flow communication with the first inlet 202 of the transition region 116 of the manifold 100. The first end 144 of the collection duct section 108 is coupled in fluid flow communication with the second inlet 204 of the transition region 116 of the manifold 100. The junction formed by the first end 144 of the collection duct section 108 and the second inlet 204 of the transition region 116 defines the first exhaust duct 110 of the manifold 100.

Thus, the inlet gap 128 is in fluid communication through the slot 160 and cavity 158 of the collection duct section 108 and both the first exhaust duct 110 and the second exhaust duct 112 with the vacuum source 52. The first exhaust duct 110 is in fluid communication through the chamber 208 of the transition region 116 and the conduit 228 of the main flow conduit 118 with the vacuum source 52. The second exhaust duct 112 is in fluid communication through the conduit 174 of the bent pipe section 114, through the chamber 208 of the transition region 116 and the conduit 228 of the main flow conduit 118 with the vacuum source 52.

Figure 10:
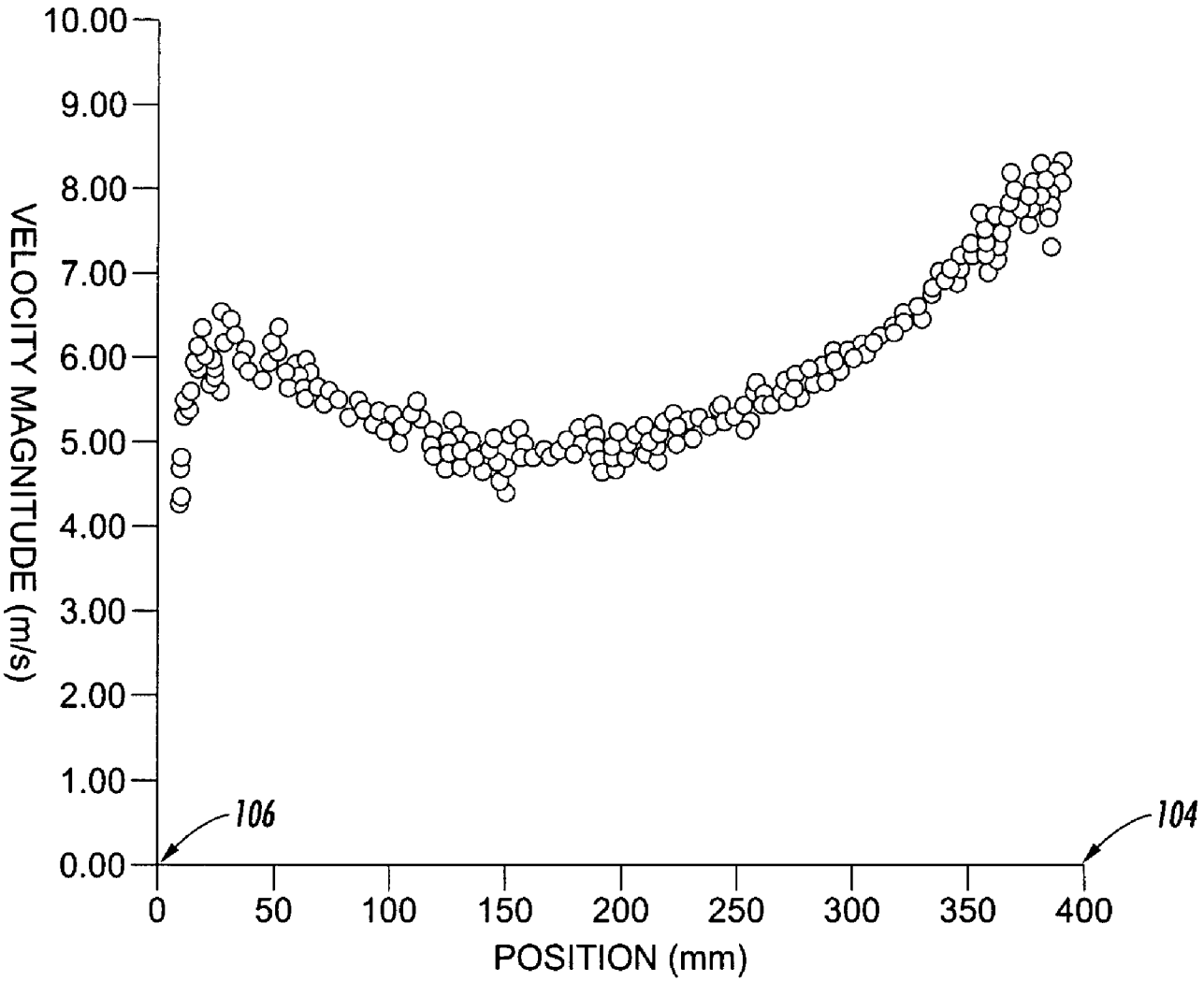
FIG. 10 is a graph of the Velocity Magnitude vs. Position for the manifold of FIG. 3.
Figure 11:
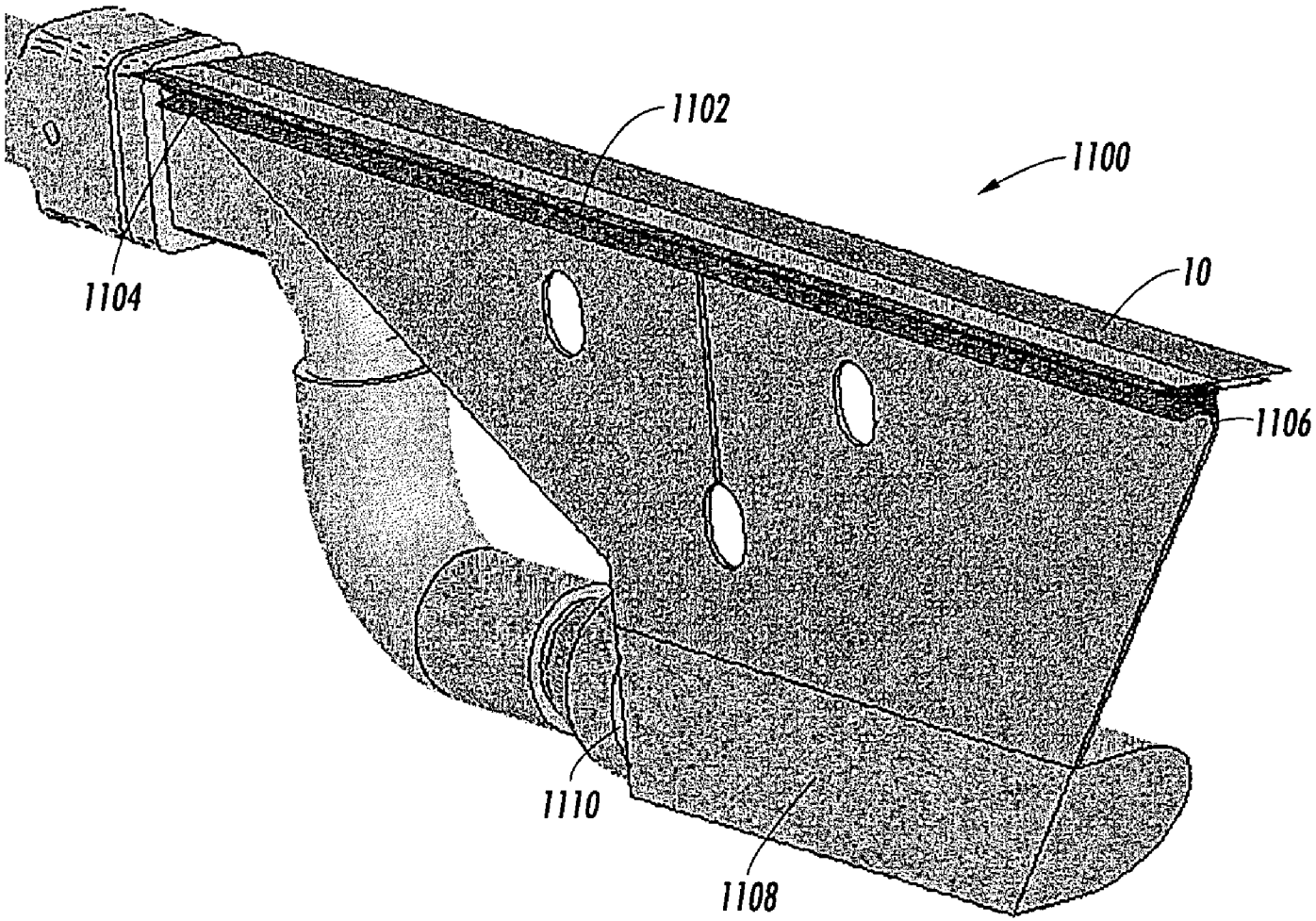
FIG. 11 (PRIOR ART)
FIG. 11 is a perspective view of a prior art single pull manifold.
Figure 12:
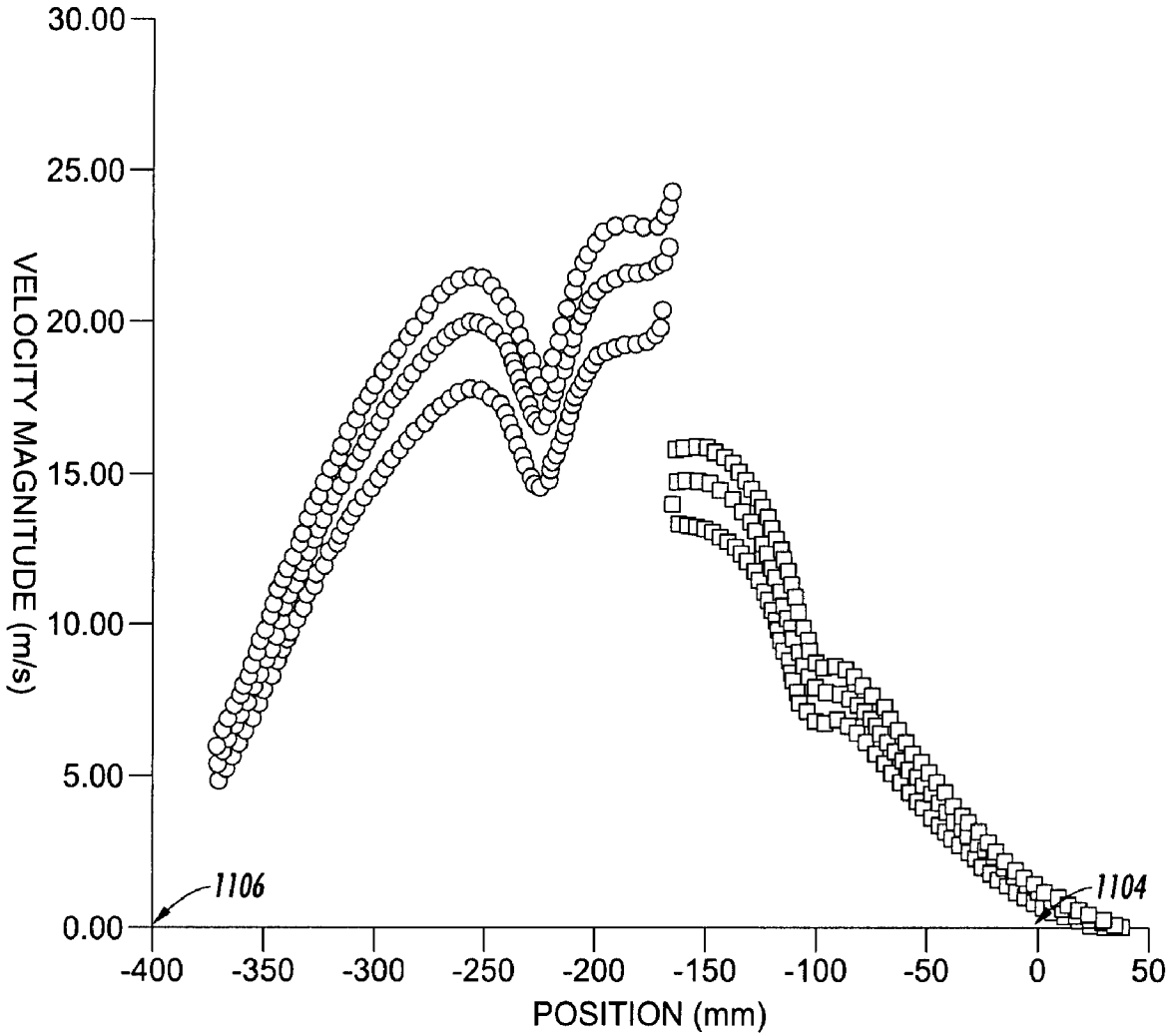
FIG. 12 (PRIOR ART)
FIG. 12 is a graph of the Velocity Magnitude vs. Position for the prior art single pull manifold of FIG. 11.

Referring now to FIG. 10, the simulated performance of the manifold 100 is illustrated. In FIG. 10, the position (mm) is measured from the second end 106 of the inlet gap 128 (position 0.0 mm) to the first end 104 of the inlet gap 128 (position 400 mm). The simulation was run utilizing a simulated manifold 100 connected to a vacuum source providing the same air flow (fifteen cubic feet per minute) as utilized in the simulation of the performance of the prior art manifold 1100 that generated the graph in FIG. 12.

Since the first exhaust duct 110 is adjacent the first end 144 of the collection duct section 108 and the first end 104 of the inlet gap 128, the velocity of the air flow in the collection region 136 adjacent the first end 104 of the inlet gap 128 is slightly higher than the velocity through the center of the inlet gap, as shown, for example, in FIG. 10. Since air flowing through the second exhaust gap 112 must travel through the bent pipe section 114, the velocity of the air in the collection region 136 adjacent the second end 106 of the inlet gap 128 is slightly lower than the velocity of the air adjacent the first end 104 of the inlet gap 128, yet is still higher than the air velocity in the center of the inlet gap 128, as shown, for example, in FIG. 10. While the velocity of the air at different longitudinal positions along the inlet gap 128 of the dual stream manifold 100 is not perfectly uniform, it is substantially more uniform than that of the prior art single pull manifold 1100. The dual stream manifold 100 does not suffer the relatively very low air velocities adjacent the ends of the inlet gap that is exhibited by the prior art single pull manifold 1100.

While the dual pull manifold 100 has been illustrated and described with reference to a specific dual end pull manifold 100, it is within the scope of the disclosure for the dual pull manifold 100 to pull from two exhaust ducts located on opposite sides of the center of the collection duct section 108.

Although the toner collection manifold has been described in detail with reference to a certain embodiment, variations and modifications exist within the scope and spirit of the present disclosure as described and defined in the following claims.

What is claimed is:

1. An airborne toner collection manifold for an electrostatographic printer for coupling in fluid flow communication with a vacuum source, the manifold comprising:

an inlet defining a gap slot extending longitudinally between a first end and a second end;

a collection duct adjacent to the inlet, the collection duct having a first end extending longitudinally at least to the first end of the gap slot of the inlet and a second end extending longitudinally at least to the second end of the gap slot of the inlet, the collection duct defining a cavity in fluid flow communication with the gap slot;

a first exhaust duct in fluid flow communication with the cavity of the collection duct and configured to be coupled for fluid flow communication with the vacuum source; and a second exhaust duct in fluid flow communication with the cavity of the collection duct and configured to be coupled for fluid flow communication with the vacuum source, the second exhaust duct being displaced from the first exhaust duct and being positioned relative to the first exhaust duct to be closer to the second end of the collection duct;

wherein the second end of the collection duct is open and the second exhaust duct is defined in part by the second open end of the collection duct;

wherein the first end of the collection duct is open and the first exhaust duct is defined in part by the first open end of the collection duct; and wherein the first end of the collection duct extends longitudinally beyond the first end of the gap slot of the inlet and the second end of the collection duct extends longitudinally beyond the second end of the gap slot of the inlet.

2. The manifold of claim 1 wherein the first end of the collection duct is open and the first exhaust duct is defined in part by the first open end of the collection duct.

3. The manifold of claim 1 wherein the collection duct is formed to include a longitudinally extending slot in fluid flow communication with the cavity and the gap slot of the inlet.

4. The manifold of claim 3 wherein the longitudinally extending slot of the collection duct has a width and a length substantially equal to a width and a length, respectively, of the gap slot.

5. The manifold of claim 1 and further comprising a transition region defining a chamber, the transition region having an inlet end wall and an outlet displaced longitudinally from the inlet end wall, the inlet end wall being formed to define a first opening coupled to the second exhaust duct to provide fluid flow communication between the cavity of the collection duct and the chamber of the transition region and a second opening coupled to the first exhaust duct to provide fluid flow communication between the cavity of the collection duct and the chamber of the transition region and wherein the outlet is configured to be coupled to the vacuum source to provide fluid flow communication between the vacuum source and the chamber of the transition region.

6. The manifold of claim 5 wherein the cross-sectional area of the chamber of the transition region decreases between the inlet end wall and the outlet.

7. The manifold of claim 5 further comprising a pipe section defining a conduit and having a first end coupled to the first opening of the transition region to provide fluid flow communication between the conduit of the pipe section and the chamber of the transition region and a second end coupled to the second exhaust duct to provide fluid flow communication between the conduit of the pipe section and the cavity of the collection duct.

8. The manifold of claim 7 further comprising a main flow section defining a conduit, the main flow section including an inlet coupled to the outlet of the transition region to provide fluid flow communication between the chamber of the transition region and the conduit of the main flow section and the outlet being configured to be coupled to the vacuum source to provide fluid flow communication between the conduit of the main flow section and the vacuum source.

9. A development system that controls the emission of airborne toner particles generated during a development process in an electrostatographic printing process, the development system comprising:

a housing defining a chamber in which the airborne toner particles are generated; and a manifold comprising:

an inlet defining a gap slot extending longitudinally between a first end and a second end;

a collection duct adjacent to the inlet, the collection duct having a first end extending longitudinally at least to the first end of the gap slot of the inlet and a second end extending longitudinally at least to the second end of the gap slot of the inlet, the collection duct defining a cavity in fluid flow communication with the gap slot;

a first exhaust duct in fluid flow communication with the cavity of the collection duct and configured to be coupled for fluid flow communication with the vacuum source; and a second exhaust duct in fluid flow communication with the cavity of the collection duct and configured to be coupled for fluid flow communication with the vacuum source, the second exhaust duct being displaced from the first exhaust duct and being positioned relative to the first exhaust duct to be closer to the second end of the collection duct;

wherein at least the inlet of the manifold is disposed in the chamber of the housing to subject airborne toner particles to a suction when the manifold is coupled to the vacuum source.

10. The development system of claim 9 wherein the manifold further comprises a transition region defining a chamber, the transition region having an inlet end wall and an outlet displaced longitudinally from the inlet end wall, the inlet end wall being formed to define a first opening coupled to the second exhaust duct to provide fluid flow communication between the cavity of the collection duct and the chamber of the transition region and a second opening coupled to the first exhaust duct to provide fluid flow communication between the cavity of the collection duct and the chamber of the transition region and wherein the outlet is configured to be coupled to the vacuum source to provide fluid flow communication between the vacuum source and the chamber of the transition region.

11. The development system of claim 10 wherein the manifold further comprises a pipe section defining a conduit and having a first end coupled to the first opening of the transition region to provide fluid flow communication between the conduit of the pipe section and the chamber of the transition region and a second end coupled to the second exhaust duct to provide fluid flow communication between the conduit of the pipe section and the cavity of the collection duct.

12. The development system of claim 11 wherein the manifold further comprises a main flow section defining a conduit, the main flow section including an inlet coupled to the outlet of the transition region to provide fluid flow communication between the chamber of the transition region and the conduit of the main flow section and the outlet being configured to be coupled to the vacuum source to provide fluid flow communication between the conduit of the main flow section and the vacuum source.

13. An electrostatographic printing machine comprising:

a development system having a housing defining a chamber, the development system being configured to generate airborne toner particles in the chamber during a development process in an electrostatographic printing process;

a vacuum source;

a manifold configured and positioned relative to the housing of the development system to control the emission of airborne toner particles generated in the chamber of the housing of the development system, the manifold comprising:

an inlet defining a gap slot extending longitudinally between a first end and a second end;

a collection duct adjacent to the inlet, the collection duct having a first end extending longitudinally at least to the first end of the gap slot of the inlet and a second end extending longitudinally at least to the second end of the gap slot of the inlet, the collection duct defining a cavity in fluid flow communication with the gap slot;

a first exhaust duct in fluid flow communication with the cavity of the collection duct and the vacuum source; and a second exhaust duct in fluid flow communication with the cavity of the collection duct and the vacuum source, the second exhaust duct being displaced from the first exhaust duct and being positioned relative to the first exhaust duct to be closer to the second end of the collection duct;

wherein at least the inlet of the manifold is disposed in the chamber of the housing to subject airborne toner particles to a suction when the manifold is coupled to the vacuum source.

14. The electrostatographic printing machine of claim 13 wherein the manifold further comprises a transition region defining a chamber, the transition region having an inlet end wall and an outlet displaced longitudinally from the inlet end wall, the inlet end wall being formed to define a first opening coupled to the second exhaust duct to provide fluid flow communication between the cavity of the collection duct and the chamber of the transition region and a second opening coupled to the first exhaust duct to provide fluid flow communication between the cavity of the collection duct and the chamber of the transition region and wherein the outlet is coupled to the vacuum source to provide fluid flow communication between the vacuum source and the chamber of the transition region.

15. The electrostatographic printing machine of claim 14 wherein the manifold further comprises a pipe section defining a conduit and having a first end coupled to the first opening of the transition region to provide fluid flow communication between the conduit of the pipe section and the chamber of the transition region and a second end coupled to the second exhaust duct to provide fluid flow communication between the conduit of the pipe section and the cavity of the collection duct.

16. The electrostatographic printing machine of claim 15 wherein the manifold further comprises a main flow section defining a conduit, the main flow section including an inlet coupled to the outlet of the transition region to provide fluid flow communication between the chamber of the transition region and the conduit of the main flow section and the outlet being coupled to the vacuum source to provide fluid flow communication between the conduit of the main flow section and the vacuum source.

* * * * *